US006390236B1

(12) United States Patent
Eastman

(10) Patent No.: US 6,390,236 B1
(45) Date of Patent: May 21, 2002

(54) DEVICE FOR METAL ROOFING PROTECTION

(76) Inventor: Liston Eastman, Ingalls Rd., R.R. 2 Box 611, Bridgton, ME (US) 04009

( * ) Notice: Subject to any disclaimer, the term of this patent is extended or adjusted under 35 U.S.C. 154(b) by 0 days.

(21) Appl. No.: 09/553,686

(22) Filed: Apr. 21, 2000

(51) Int. Cl.[7] ..... E04G 5/02; E06C 7/06

(52) U.S. Cl. ..... 182/107; 182/214

(58) Field of Search ..... 182/108, 107, 182/214, 129; 224/264, 265, 907, 270

(56) References Cited

U.S. PATENT DOCUMENTS 3,115,212 A 12/1963 Keatley ..... 182/108
3,447,631 A 6/1969 Smith ..... 182/108
4,726,446 A 2/1988 Perbix ..... 182/107 X
4,899,848 A 2/1990 Parr ..... 182/108

*Primary Examiner*—Daniel P. Stodola
*Assistant Examiner*—Hugh B. Thompson
(74) *Attorney, Agent, or Firm*—Kevin M. Farrell

(57) ABSTRACT

A device for maintaining a ladder in a parallel orientation relative to a surface, such as a roof. The device is comprised of a flexible U-shaped internal element having an inner side, an outer side and a lower side. A slot formed between these three sides is shaped and sized to frictionally engage a ladder rail. A flexible external covering fitted to the internal element is also provided. The flexible external covering includes attachment apparatus for securing the device to the ladder rail.

5 Claims, 3 Drawing Sheets

DEVICE FOR METAL ROOFING PROTECTION

BACKGROUND OF THE INVENTION

The application of metal roofing material in place of conventional asphalt shingles has become an increasingly popular alternative for today's home builders. Metal roofing offers a variety of advantages, particularly in areas which receive moderate to significant annual snowfalls. Due to the absence of granular surface material, metal roofs tend to be quite slippery allowing snow to slide off without substantial build-up. This tends to eliminate the ice-damming problem often associated with snow build-up on conventional asphalt shingle roofing.

This desirable "slickness" property associated with metal roofing is, however, disadvantageous when it is necessary for workmen to move about the roof. Typically, this will occur when the roofing is initially installed, or during maintenance activities (e.g., chimney work). A common means for providing security to workmen on metal roofing surfaces is to hoist a ladder onto the surface of the roof and secure the ladder (typically by means of a hook) to the ridge of the roof. Ladders are constructed from materials which, when slid across the surface of a metal roof, tend to scratch the surface. Such scratches are unsightly and very noticeable from the ground. Scratches of this type are very difficult to repair and should be avoided at all costs.

One means for avoiding scratches of the type described above is to tie towels or rags around the ladder so that as the ladder is slid into position, the applied materials tend to insulate the ladder rails from direct contact with the roof thereby preventing damage to the roof. While this is sometimes effective, the application of these protective materials to the ladder rails is time-consuming. In addition, they can shift quite easily exposing a sharp rail edge which can damage the roof. The development of a more reliable means for protecting a metal roofing surface during installation and maintenance is a desirable goal.

SUMMARY OF THE INVENTION

The present invention relates to a device for maintaining a ladder in a parallel orientation relative to a surface, such as a roof. The device is comprised of a flexible U-shaped internal element having an inner side, an outer side and a lower side. A slot formed between these three sides is shaped and sized to frictionally engage a ladder rail. A flexible external covering fitted to the internal element is also provided. The flexible external covering includes attachment means for securing the device to the ladder rail.

The device of the present invention is intended primarily for use in connection with the maintenance and installation of metal roofing product. Metal roofing is easily scratched, and these scratches are often easily seen from the ground. The present device is designed to protect the metal roof from damage by preventing ladders used for support from touching the metal surface. In preferred embodiments, portions of the device of the present invention which are likely to come in contact with the roof surface are manufactured from, or covered with, a soft non-abrasive material.

DETAILED DESCRIPTION OF THE INVENTION

Figure 1:
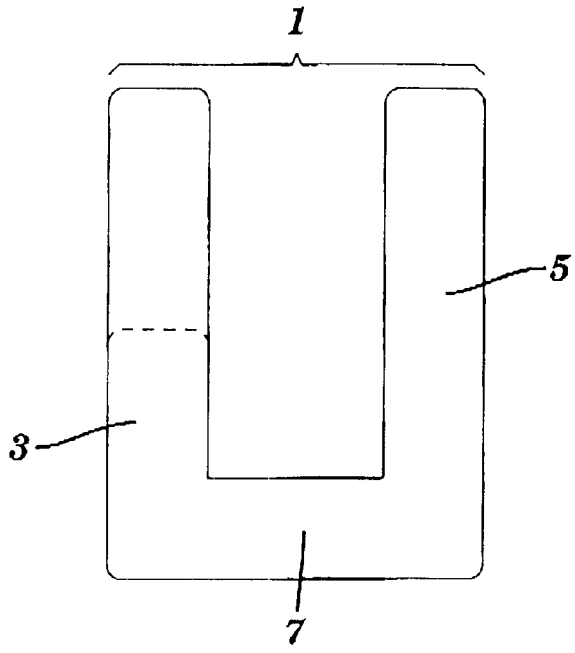
FIG. 1 is a side view of the flexible U-shaped internal element of the present invention.

The present invention relates to a device for maintaining a ladder in a parallel orientation relative to an inclined surface. In a preferred embodiment, the device finds application in the metal roofing industry. In particular, in a preferred embodiment, the device of the present is useful for protecting a metal roof from scratching which can occur when a ladder is slid along the surface of a metal roof. As discussed above, this is a common problem encountered during roofing installation or roof/chimney maintenance.

Non-extension ladders are typically employed during installation and maintenance work on metal roofing. As discussed more fully above, such ladders are hoisted onto the roofing surface, then slid into position. Typically a hook is positioned at one end of the ladder which engages the ridge of the roof with the ladder extending lengthwise down the roof slope. While sliding the ladder into position, the rungs of the ladder may be parallel with the roof. However, to avoid the contact of the ridge hook with the metal roof, the ladder is often oriented with the rungs 90° to the roof surface while sliding into position.

In a preferred embodiment, the device of the present invention comprises a flexible U-shaped internal element having an inner side, outer side and a lower side. The internal element is preferably shaped to frictionally engage a ladder rail. The device also comprises a flexible external covering fitted to the internal element. The flexible external covering has an attachment means for securing the device to the ladder rail.

The internal element is made from a material which flexes to engage a ladder rail. Those skilled in the art would be familiar with a variety of materials which would satisfy the property requirements for such a material. An example of such a material is closed-cell foam.

The flexible external covering is preferably comprised of a fabric material. Although natural materials such as cotton may be used, synthetics such as nylon are preferred. Such synthetics possess a number of desirable properties including their non-absorbent properties, and increased strength. The flexible external covering is shaped and stitched to follow the contours of the internal element. If desired, the external covering may be constructed in such a way that it is removable for easy cleaning or replacement. In preferred embodiments, portions of the external covering which contact the lower side and the outer side of the internal element are faced with a soft, non-abrasive material. Polyester fleece material is an example of such a soft, non-abrasive material.

In preferred embodiments, the means for securing the device to the ladder rail comprises a flexible flap which is permanently fixed to a portion of the external covering which covers the inner side of the internal element. This means for securing the device attaches reversibly to the portion of the external covering which covers the outer side of the internal element. It will be recognized, of course, that the means for securing the device may comprise a flexible flap which is permanently fixed to a portion of the external covering which covers the outer side of the internal element, and which reversibly attaches to a portion of the external covering which covers the inner side of the internal element. Any suitable attachment means may be employed to secure the device to the ladder rail including, for example, hook and loop means, snaps, buttons and the like.

In preferred embodiments, the inner side of the internal element is partially slotted to prevent movement of the ladder while positioned on the roof. The partial slot can begin at the top edge of the inner side and extend down the inner side of the internal element a sufficient distance such that a ladder rung may be slideably engaged with the partial slot when the device is fully seated on the ladder rail.

In use, a device of the present invention is attached at or near each of the 4 rail ends of a ladder. Preferably, 2 or more device of the present invention are secured at rail positions intermediate the rail ends. The positioning of the devices should be selected such that in use (i.e., with an adult walking along the rungs of the ladder), no structural portion of the ladder makes contact with the roof.

DETAILED DESCRIPTION OF PREFERRED EMBODIMENTS

The present invention relates to a device for maintaining a ladder in a parallel orientation relative to a surface (e.g., a roof). The device is comprised of a flexible U-shaped internal element and a flexible covering fitted to the internal element. Referring to FIG. 1, the flexible U-shaped internal element (1) is shown in side view. The flexible internal element has an inner side (3), an outer side (5) and a lower side (7). A slot formed between inner side (3), outer side (5) and lower side (7) engages a ladder rail when in use.

Figure 2:
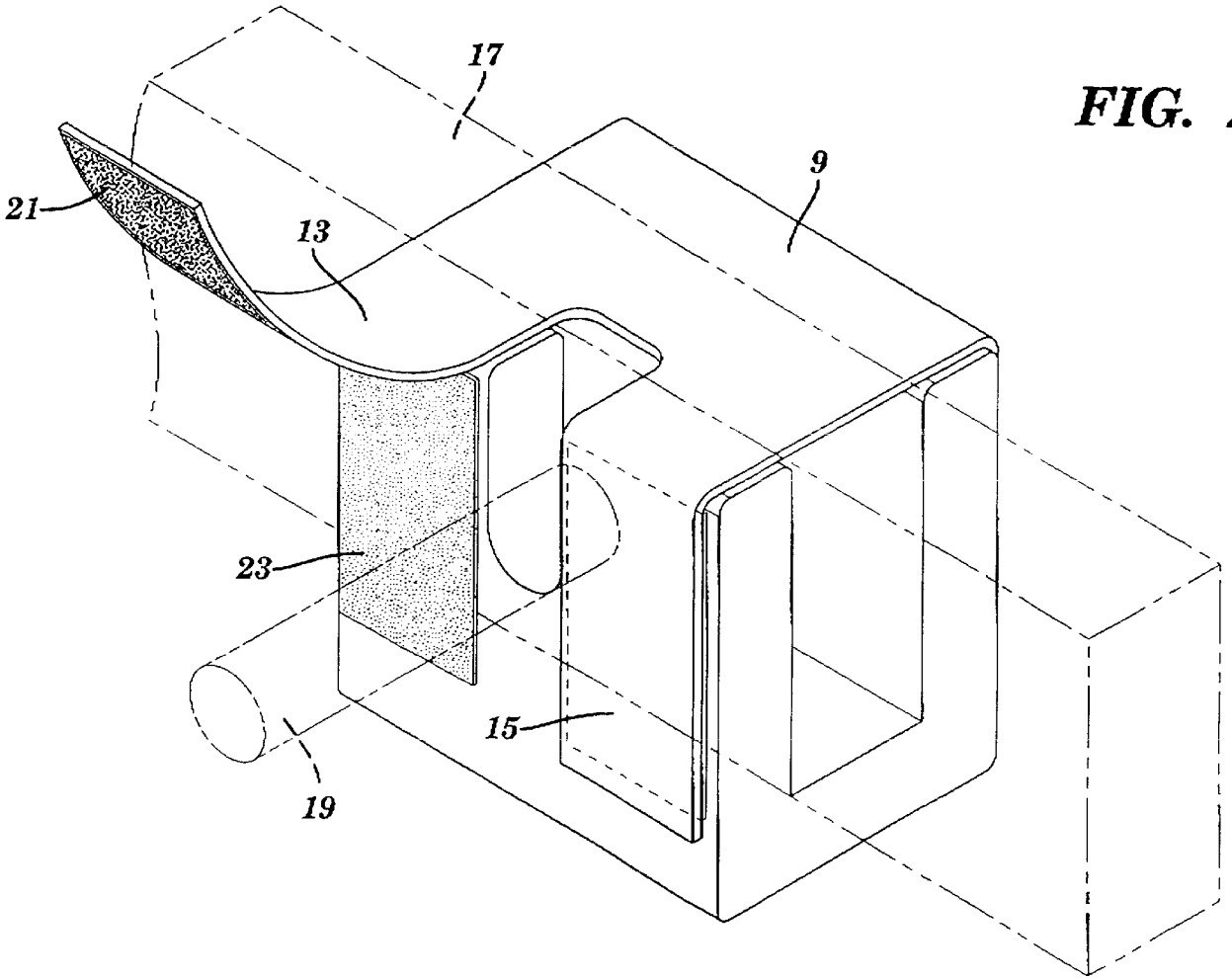
FIG. 2 is a perspective view of the device of the present invention with the ladder rail and rung shown in phantom.

FIG. 2 is a perspective view showing the device of the present invention with a flexible covering (9) fit in place over the internal element. The flexible covering slides over the internal element in a manner similar to a sock fitting over a foot and conforms to the shape of the internal element. Preferably, the internal element is slid into the flexible covering (9) through an opening in the bottom of the flexible covering. An insertion flap (not shown) would be closed and secured following insertion of the internal element. The insertion flap can be reversibly secured using, for example, a hook and loop mechanism, or a more permanent securing means such as stitching may be employed. Also shown are straps (13 and 15) which serve to secure the device in position around a ladder rail (17) and ladder rung (19). As drawn, straps (13 and 15) are stitched to the portion of the external covering which covers the outer side of the internal element. The straps attach reversibly to a portion of the external covering which covers the inner side of the internal element. Patches of hook and loop material (21 and 23, respectively) are secured to the straps and the external covering to reversibly secure the device.

Figure 3:
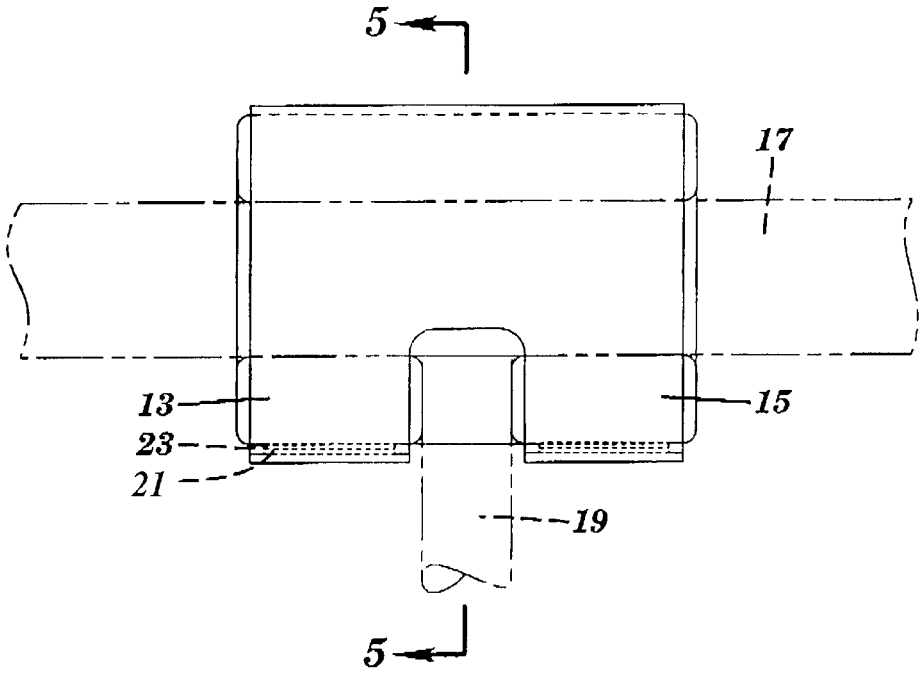
FIG. 3 is a top view of the device of the present invention with the ladder rail and rung shown in phantom.

Referring to FIG. 3, a top view of the device in use is shown. Ladder rail (17) and ladder rung (19) are engaged by the device. Straps (13 and 15) are stitched to a portion of the external covering which covers the outer side of the internal element. Straps (13 and 15) attach reversibly to the portion of the external covering which covers the inner side of the internal element. Patches of hook and loop material (21 and 23) are indicated by broken lines.

Figure 4:
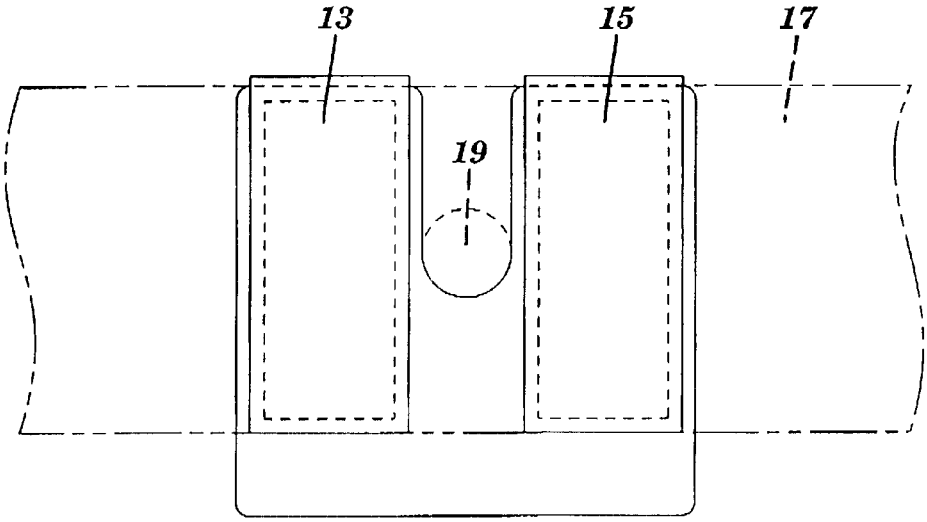
FIG. 4 is a side view of the device of the present invention with the ladder rail and rung shown in phantom.

Referring to FIG. 4, this side view shows the device of the invention in use. Ladder rail (17) and ladder rung (19) are engaged by the device. Straps (13 and 15) which secure the device when in use are shown in the secured position with hook and loop patches indicated with broken lines beneath straps (13 and 15).

Figure 5:
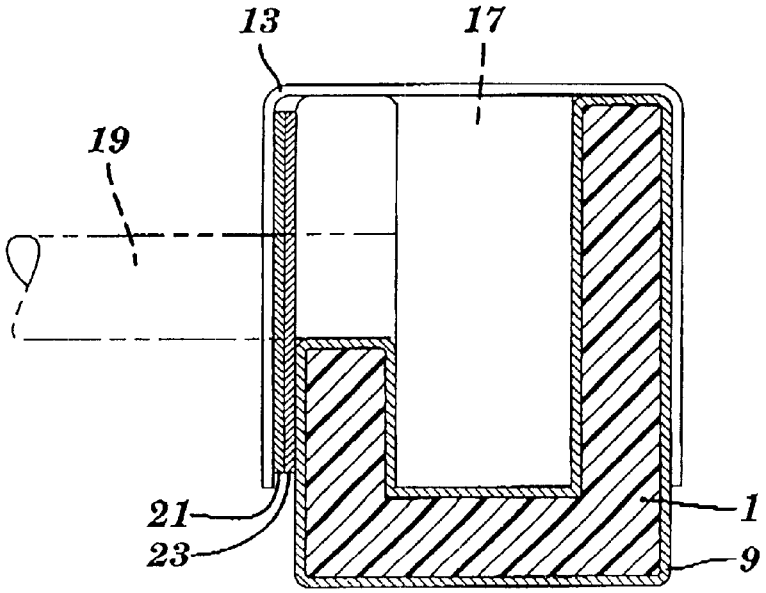
FIG. 5 is a cross-sectional view taken along line 5 as shown in FIG. 3.

Referring to FIG. 5, the device of the invention is shown in cross-section engaging ladder rail (17) and ladder rung (19). FIG. 5 shows the internal element (1), flexible covering (9), strap (13) is stitched to the flexible covering and hook and loop patches (21 and 23) securing the device in place (strap 15 is not seen in this view).

Although not shown in the drawings, preferred embodiments of the device of the present invention have a soft, non-abrasive covering over the portion of the flexible covering which covers the lower side of the internal element and the outer side of the internal element.

What is claimed is:

1. A device for maintaining a ladder in a parallel orientation relative to a surface, the device comprising:

a) a flexible U-shaped internal element having an inner side, an outer side and a lower side, the element being shaped to form a channel to frictionally engage a ladder rail received therein; and a slot in said inner side and extending inwardly therefrom toward said channel for receiving a rung of said ladder; and b) a flexible external covering fitted to the internal element, the flexible external covering having an attachment means for securing the device to the ladder rail.

2. The device of claim 1 wherein at least the portion of the flexible external covering which covers the lower side of the internal element is produced from or is covered with a soft, non-abrasive material.

3. The device of claim 1 wherein at least the portion of the flexible external covering which covers the outer side of the internal element is produced from or is covered with a soft, non-abrasive material.

4. The device of claim 1 wherein the means for securing the device to the ladder rail comprises a flexible flap which is permanently fixed to a portion of the external covering which covers the inner side of the internal element, and which removably attaches to the portion of the external covering which covers the outer side of the internal element.

5. The device of claim 4 wherein the reversible attachment is effected through a loop and hook fastener.

* * * * *